US005645164A

United States Patent [19]

Hocking

[11] Patent Number: 5,645,164

[45] Date of Patent: Jul. 8, 1997

[54] PAINT ROLLER TRAY WITH COVER

[76] Inventor: Homer Douglas Hocking, P.O. Box 2275, Lake Arrowhead, Calif. 92352

[21] Appl. No.: 676,061

[22] Filed: Jul. 5, 1996

[51] Int. Cl.[6] ..... B65D 43/16

[52] U.S. Cl. ..... 206/209; 206/15.3

[58] Field of Search ..... 206/209, 205, 206/1.8, 361, 362, 362.1, 362.2, 362.3, 15.2, 15.3

[56] References Cited

U.S. PATENT DOCUMENTS 4,802,576 2/1989 Kern ..... 206/361 X 5,553,701 9/1996 Jarechi et al. ..... 206/15.2

*Primary Examiner*—Jacob K. Ackun

*Attorney, Agent, or Firm*—Robert N. Schlesinger

[57] ABSTRACT

This invention relates to a one-piece and closeable paint roller tray with attached cover, where the paint tray body may securely accommodate a standard sized paint tray liner. The paint tray body is also designed to accommodate paint tools, such as a standard paint brush and a paint roller with handle, within said tray body, when the paint tray invention is in the closed position, with the attached paint tray cover positioned over the paint tray body. Said paint tray is also designed to accommodate said paint tools, on the sloped rollout platform and out of the paint well, with the handle of each tool protruding from two orifices in the front of the paint tray, and when the paint tray is in use. The sloped rollout platform of the paint tray invention has a paint flow channel embedded within said platform, and said channel is designed to also function as stable paint tray legs.

16 Claims, 20 Drawing Sheets

PAINT ROLLER TRAY WITH COVER

BACKGROUND - FIELD OF THE INVENTION

This Paint Roller Tray with Cover, and hereinafter referred to as the "Paint Tray", was devised and invented by Homer Douglas Hocking, and relates to the construction of a one-piece molded and closeable paint roller tray, with attached cover. The present Paint Tray invention may accommodate a standard size paint tray liner (35), and the attached cover of said Paint Tray may be closed by the user, and with said liner (35) within said tray. The present Paint Tray invention may also accommodate standard size painting tools, such as a paint brush (37) and a paint roller with handle (36), out of the Paint Tray's paint well (11), and with the Paint Tray's cover (1) in the closed position. A preferred embodiment of the present Paint Tray invention is also stackable in the closed position, and with paint (38) and painting tools within said tray, thereby preserving the paint (38) for a few days, if need be, until a painting job is resumed.

Paint roller trays are typically manufactured in three sizes: commercial size, residential size, and mini size. The present Paint Tray invention may be manufactured in any size, including the above mentioned three sizes. In a primary embodiment, the Paint Tray is intended for use as a standard sized, commercial paint tray, and may, as indicated above, house a paint tray liner (35), in either the opened or closed positions. Paint tray liners are also manufactured in a standard size, and which will house the roller portion of a standard sized paint tray roller with handle (36), along the width of said liner (35).

The Paint Tray is manufactured by a molding process, and preferably by thermal formed molding. The Paint Tray is composed essentially of a polymeric material, which is durable, chemically compatible with commercial paint (38), and strong enough to house a full paint well (11). Such polymeric materials include PETE, and material olefins, such as polyethylene, polypropylene, and clarified polypropylene if the Paint Tray is to also display products contained therein, such as a paint brush (37), paint roller with handle (36), and the like.

In some embodiments, a suitable colorant may be added to the polymeric formulation, to add the desired coloration to the Paint Tray. In some preferred embodiments of the Paint Tray, graphite particles or fibers may be added to the polymeric formulation, such as PETE, in order to achieve a non-stick quality to the tray body (2) or to a similarly composed paint tray liner (35), if the paint should dry; in which case, the hardened paint could be knocked out of the tray body (2) or the liner (35). A preferred embodiment of the Paint Tray would have a black or clear coloration, because the other colorations may interfere with the user's judgement in mixing paints and achieving the desired color or shade.

DESCRIPTION OF PRIOR ART AND NEED FOR THE PRESENT INVENTION

A primary application of this invention is to offer the manufacturer a paint roller tray which is lightweight, yet strong, and inexpensive to manufacture, stackable when stockpiled in the open position, and in some preferred embodiments stackable when stockpiled in the closed position, with display goods, such as a paint brush (37) and paint roller with handle (36), within the closed tray. See FIGS. 1 and 20.

Another primary application of this invention is to offer the user a paint tray which is inexpensive and therefore disposable, which has an attached tray cover (1), and that said cover (1) also will close over the paint tray body (2), when a paint tray liner (35) is housed within the tray body (2).

DRAWING FIGURES

The drawing figures reflect a preferred embodiment of the Paint Tray, as is intended for use with a standard paint brush (37) and a standard paint roller with handle (36), but, the Paint Tray and its preferred embodiment is not limited to such use, and may, e.g., be used in a smaller size, and with differing paint tools. The preferred embodiment of the Paint Tray, as shown in the drawing figures, is also intended for the optional use with a standard sized paint tray liner (35), which will fit within the tray body (2) of the Paint Tray, when the tray is in either the open or the closed position, as shown in FIGS. 19 and 20.

Figure 4:
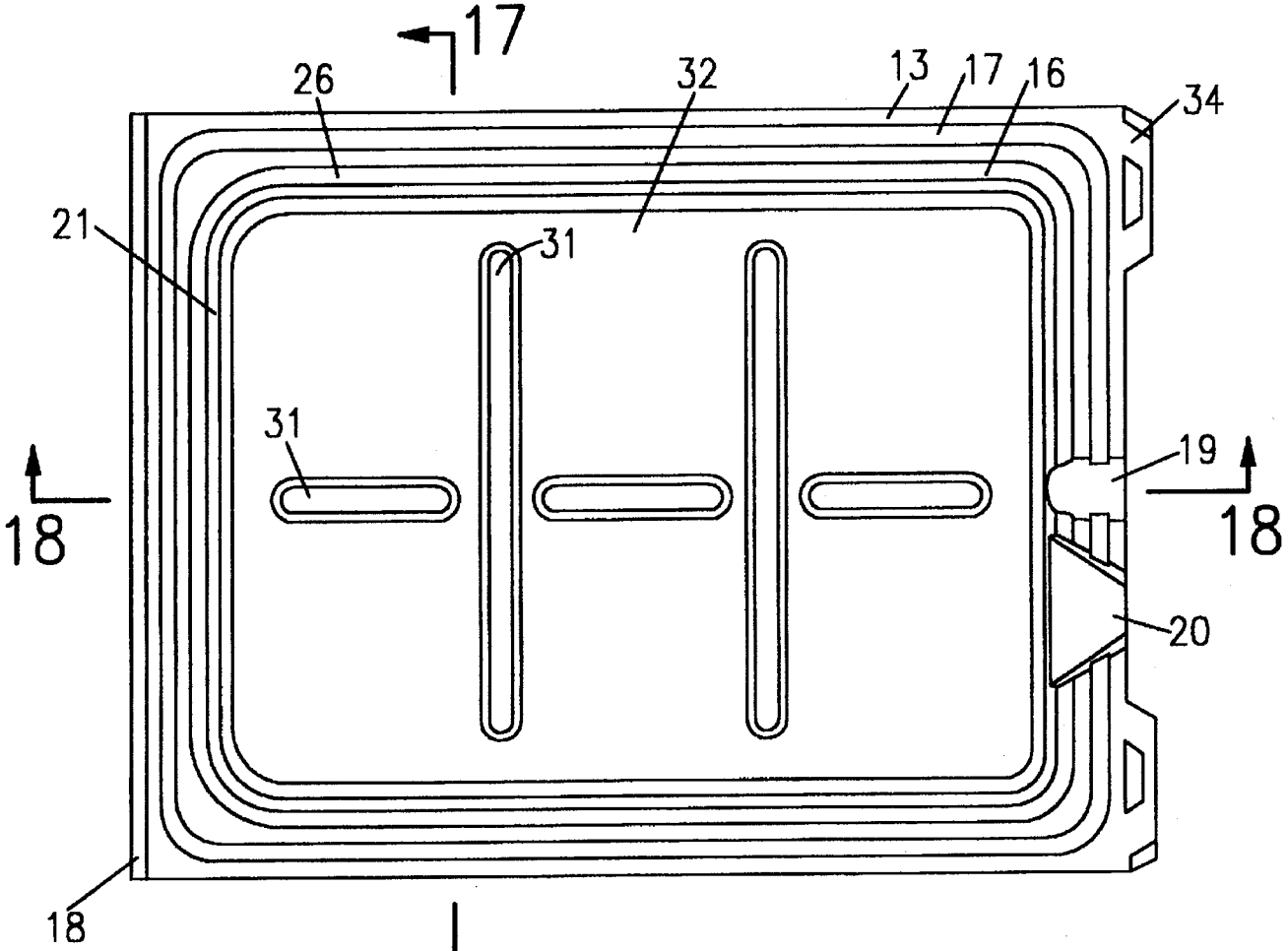
FIG. 4 shows a top view of the preferred embodiment of the Paint Tray in the closed position.
Figure 19:
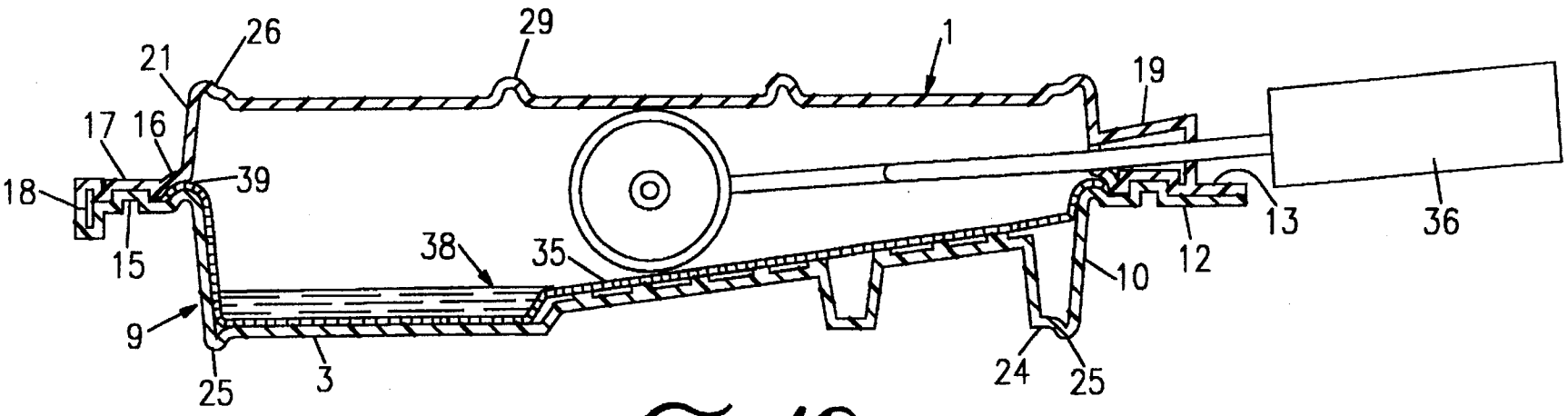

FIG. 19 shows a sectional side view along the length of the preferred embodiment of the Paint Tray in the closed position, whereby said section is made along lines 18—18 of FIG. 4, and showing a sectional view of a paint tray liner (35) within said Paint Tray, and a paint roller with handle (36) in the storage position within said Paint Tray with liner, and showing some paint (38) within the paint well (11), but not within the tray leg (24).

Figure 20:
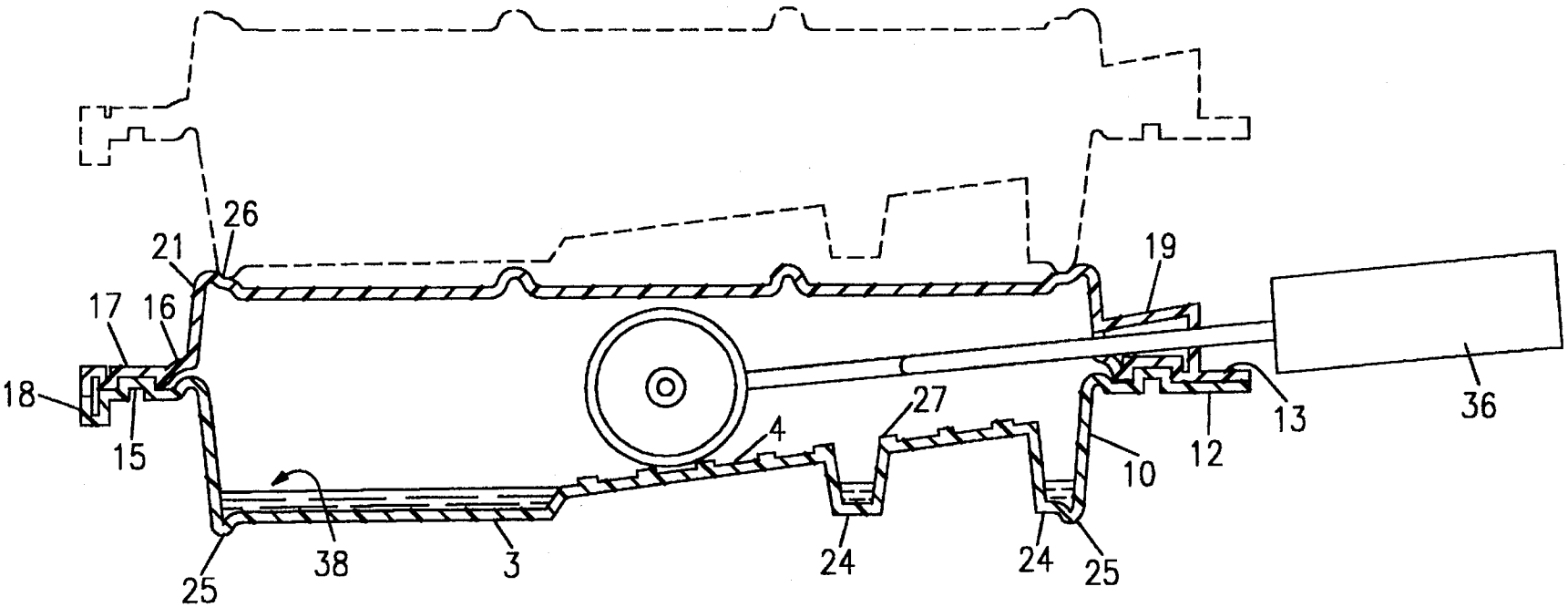

FIG. 20 shows a sectional side view along the length of the preferred embodiment of the Paint Tray in the closed position with a paint roller with handle (36) within the sectioned Paint Tray, whereby said section is made along lines 18—18 of FIG. 4, and showing how another similar Paint Tray may be stacked upon the shown sectioned Paint Tray.

REFERENCE NUMERALS IN THE DRAWING FIGURES

Referring now to the drawing figures, like reference numerals are used to refer to like specific parts, or elements, of the various Figures. The reference numerals used in the drawing figures and throughout the specification in parentheses, to describe the various parts of the Figures follows.

1. Tray Cover (1), is the attached portion, i.e. half, of the Paint Tray, which may be moved or flipped forward approximately 180 degrees along the hinge (18), and over the top of the bottom of the Paint Tray, i.e., the tray bottom (2), thereby forming a seal, or non-airtight seal. The tray cover (1) may, in some preferred embodiments, have a plurality of reinforcing ridges (30 and 31) running the length and width of the tray cover (1), and may also have indicata or instructions molded onto said cover (1), to provide further reinforcement.

2. Tray Body (2), is the half of the Paint Tray which is mated to the tray cover (1), and contains, inter alia, the paint well (11) and the sloping rollout platform (4)

3. Paint Well Bottom (3), is the outside or exterior surface of the paint well (11), and said bottom (3) acts as a support or leg for the Paint Tray.

4. Sloped Rollout Platform (4), is the sloped region on the interior surface of the Paint Tray, extending at its most elevated point, generally from the front end of said tray body (2), to the lowest elevated point of said platform (4), and to the front portion of the paint well (11).

5. Front Slope of Paint Well (5), is the sloping region which is the interface between the sloping rollout platform (4) and bottom of the front of the paint well (11).

6. Rear Slope of Paint Well (6), is the sloping region at the rear of the paint well (11) and comprising the rear wall of the paint well (11), and comprising the transition between the paint tray (11) and the rear sidewall (9).

7. Left Sidewall (7), is the left wall running the length of the tray body (2), along the left side.

8. Right Sidewall (8), is the right wall running the length of the tray body (2), along the right side.

9. Back Sidewall (9), is the back wall comprising the back of the tray body (2).

10. Front Sidewall (10), is the front wall comprising the front of the tray body (2).

11. Paint Well (11), is region at the back of the interior of the tray body (2), and is the region at the lowest elevation in the interior of the tray body (2), and is intended to house paint (38).

12. Outer Tray Flange (12), is the flange at the outer end of the front end, the back end, the left side, and the right side of the tray body (2), and where the top of the tray body (2) meets the tray cover (1), when said cover (1) is flipped over and onto the top of the tray body (2).

13. Outer Cover Flange (13), is the flange at the outer end of the front end, the back end, the left side, and the right side of the tray cover (1), and where the bottom of the tray cover (1) meets the top of the tray body (2), when said cover (1) is flipped over and onto the top of the tray body (2).

Figure 17:
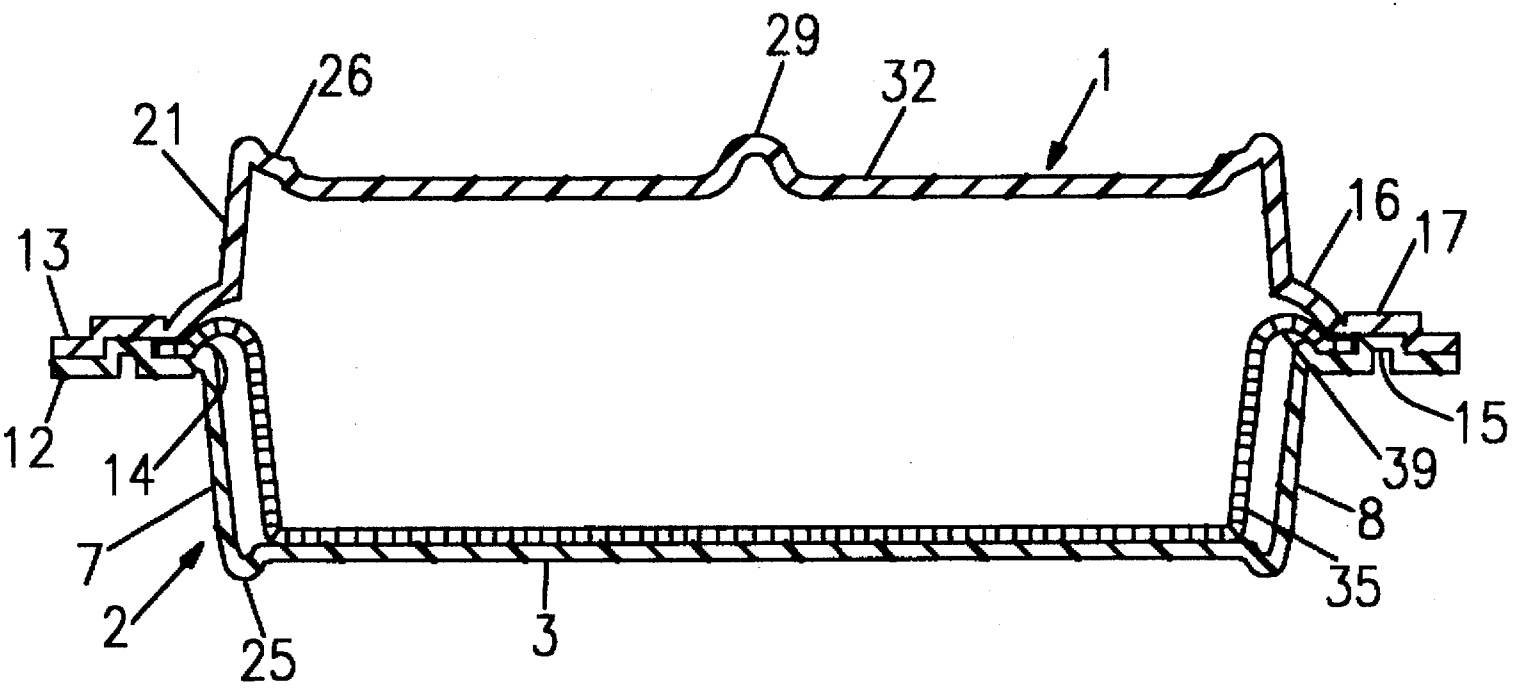
FIG. 17 shows a sectional side view along the width of the preferred embodiment of the Paint Tray in the closed position, whereby said section is made along lines 17—17 of FIG. 4.
Figure 18:
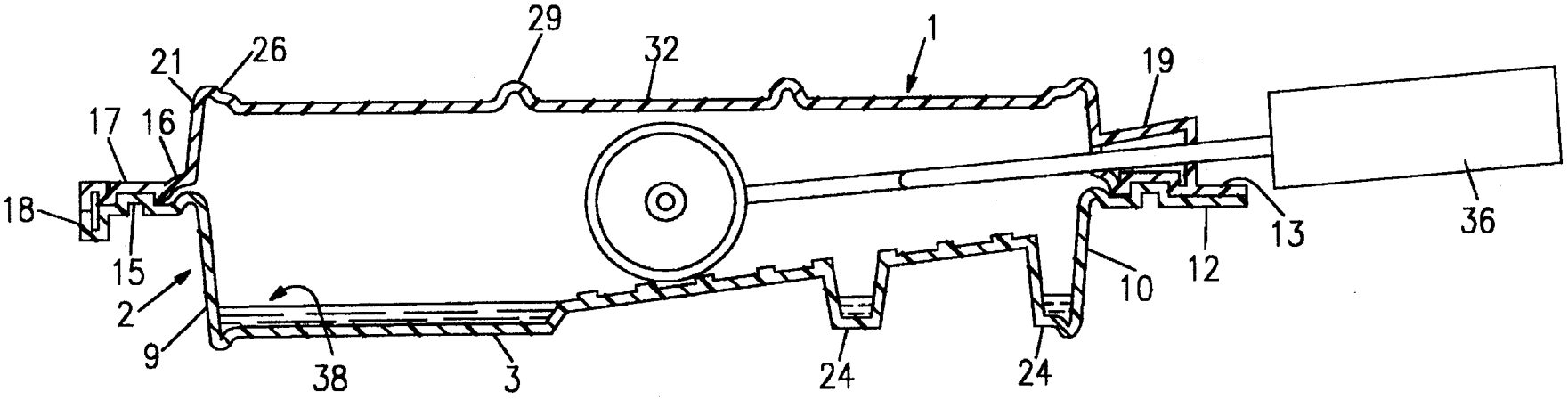
FIG. 18 shows a sectional side view along the length of the preferred embodiment of the Paint Tray in the closed position, whereby said section is made along lines 18—18 of FIG. 4, and with a paint roller with handle (36) in the storage position within said Paint Tray, and showing some paint (38) within the paint well (11) and within the flow channel (22), which also acts as the tray leg (24).

14. Tray Inner Radius (14), is the protruding radius running the perimeter of the top of the tray body (2), the inner portion of said radius (14) sloping into the tray body (2) to form the inner wall of said tray body (2), and the tray inner radius (14) matedly fits together with the cover inner radius (16), which is recessed to mate with the tray inner radius (14); said tray inner radius (14) may be a squared or a curved protruding radius. Said radius (14) is a half radius along the top of left sidewall (7) and the top of right sidewall (8), but said radius (14) is a full radius along the top of back sidewall (9) and the top of front sidewall (10). See FIGS. 17 and 19.

15. Tray Body Alignment Tang (15), is the protruding tang running the length of the right side, the left side, the back side, and the front side of the top of the tray body (2), and the tray body alignment tang (15) matedly fits together with the cover alignment tang (17), which is recessed to mate with the tray body alignment tang (15); said tang (15) may be a squared or a curved protruding tang.

16. Cover Inner Radius (16), is the recessed radius running the perimeter of the inner surface of the tray cover (1), and the cover inner radius (16) matedly fits together with the tray inner radius (14), which is protruding to mate with the cover inner radius (16); said cover inner radius (16) may be a squared or a curved recessed radius, but must be compatible with the tray inner radius (14) for a mated fitting.

17. Cover Alignment Tang (17), is the recessed tang running the length of the right side, the left side, and the front side of the tray cover (1), and the cover alignment tang (17) matedly fits together with the tray body alignment tang (15), which is protruding to mate with the cover alignment tang (17); said tang (17) may be a squared or curved recessed tang, but must be compatible with the tray body alignment tang (15) for a mated fitting.

18. Hinge (18), is the connected and flexible interface between the tray body (2) and the tray cover (1), located along the length of the rear of the Paint Tray; the hinge also acts as a preliminary alignment device, to align the various elements, and particularly the elements on the tray body (2) with their mates on the tray cover (1), of the Paint Tray invention.

19. Semicircular Opening (19), is located at the front of the tray cover (1), and is optionally used to allow a paint roller with handle (36) to be housed within the Paint Tray, and outside the paint well (11) and on the sloped rollout platform (4), with the handle of said paint roller (36) protruding from the Paint Tray, when said Tray is in the closed, as well as the open position.

20. Rectangular Opening (20), is located at the front of the tray cover (1), and is optionally used to allow a paint brush (37) to be housed within the Paint Tray, and outside the paint well (11) and on the rollout platform (4), with the handle of said brush (37) protruding from the Paint Tray, when said Tray is in the closed, as well as the open position.

21. Elevated Top of Cover (21), is the elevated region protruding from the main body of tray cover (1).

22. Paint Flow Channel (22), is the entire channel, which has a bottom at generally the same elevation as the bottom of the paint well (11), and which is generally running through the rollout platform (4) in a geometric pattern, and which may also run along the left, right, or front perimeter of the rollout platform, or in a combination thereof.

23. Paint Flow Sub-Channel (23), is a selected portion of the paint flow channel (22), and generally a linear region thereof.

24. Tray Leg (24), is the means for keeping the Paint Tray stable and in the optimal position desirable for use, the tray leg (24) is the protruding radius from the paint flow channel (22) and the various paint flow sub-channels (23), when viewed from the bottom of the tray body (2).

25. Leg Rib (25), is the protruding region located on selected tray legs (24) and protruding from the exterior surface of the paint well bottom (3), in some preferred embodiments of the Paint Tray, and which provides a means for further stabilizing the Paint Trays, when stacked in the closed position, by matedly fitting onto the appropriately located recessed leg rib receptor (26), located on the exterior surface of the tray cover (1).

26. Leg Rib Receptor (26), is the recessed region located on the exterior surface of the tray cover (1), in some preferred embodiments of the Paint Tray, and when two or more Paint Trays are stacked, the stack is further stabilized by means of the leg ribs (25) of the upper Paint Tray, matedly fitting into the leg rib receptors (26) of the lower Paint Tray, as shown in FIG. 20.

Figure 5:
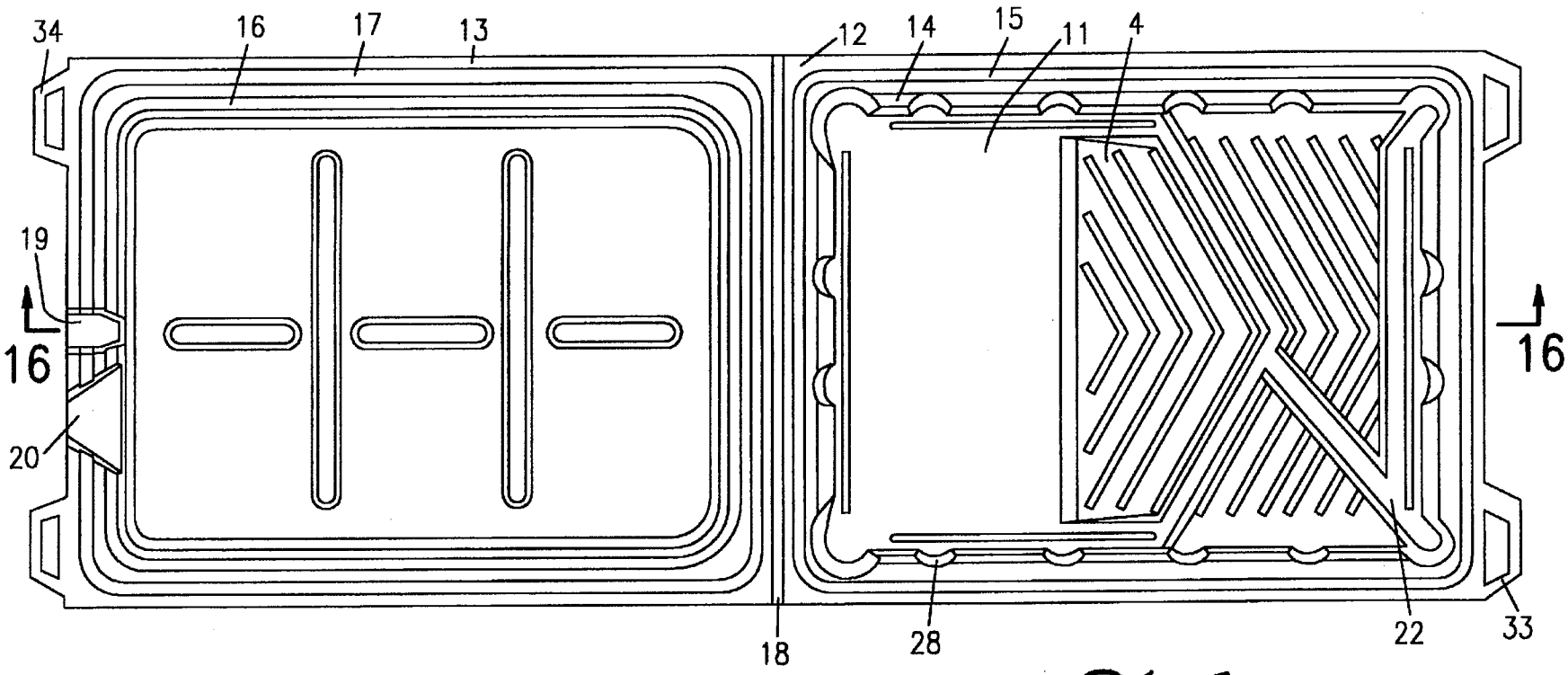
FIG. 5 shows a top view of the preferred embodiment of the Paint Tray in an open position.
Figure 6:
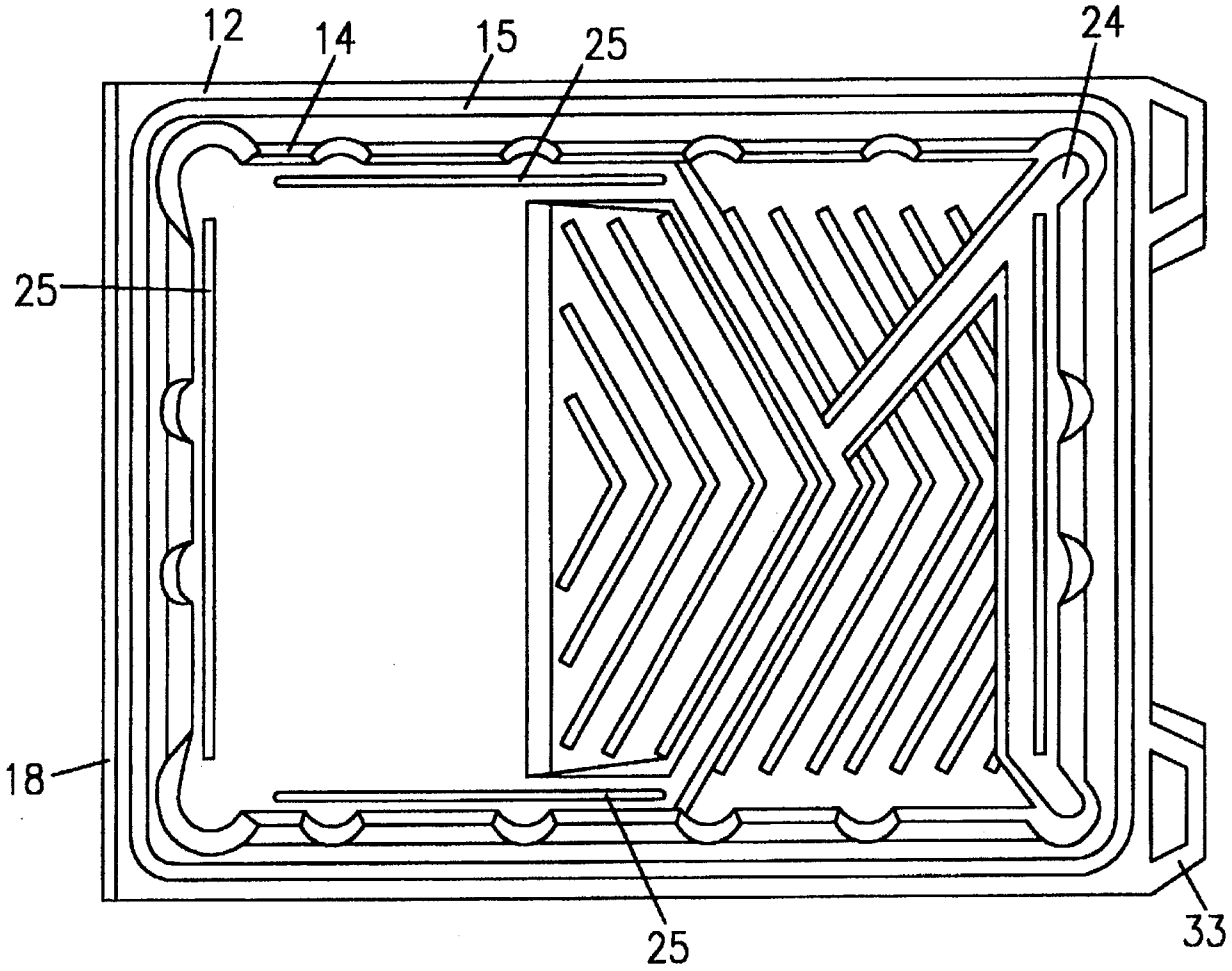
FIG. 6 shows a bottom view of the preferred embodiment of the Paint Tray in the closed position.
Figure 7:
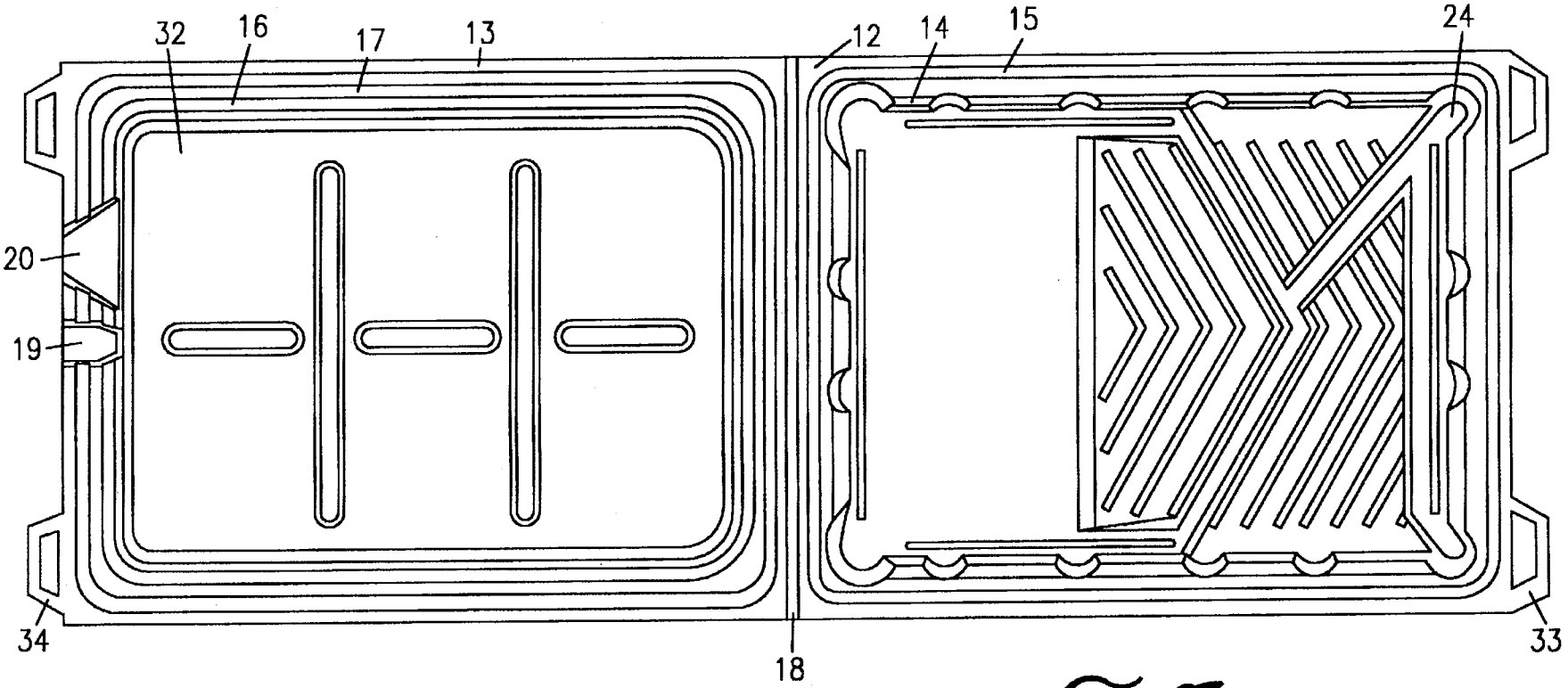
FIG. 7 shows a bottom view of the preferred embodiment of the Paint Tray in an open position.
Figure 8:
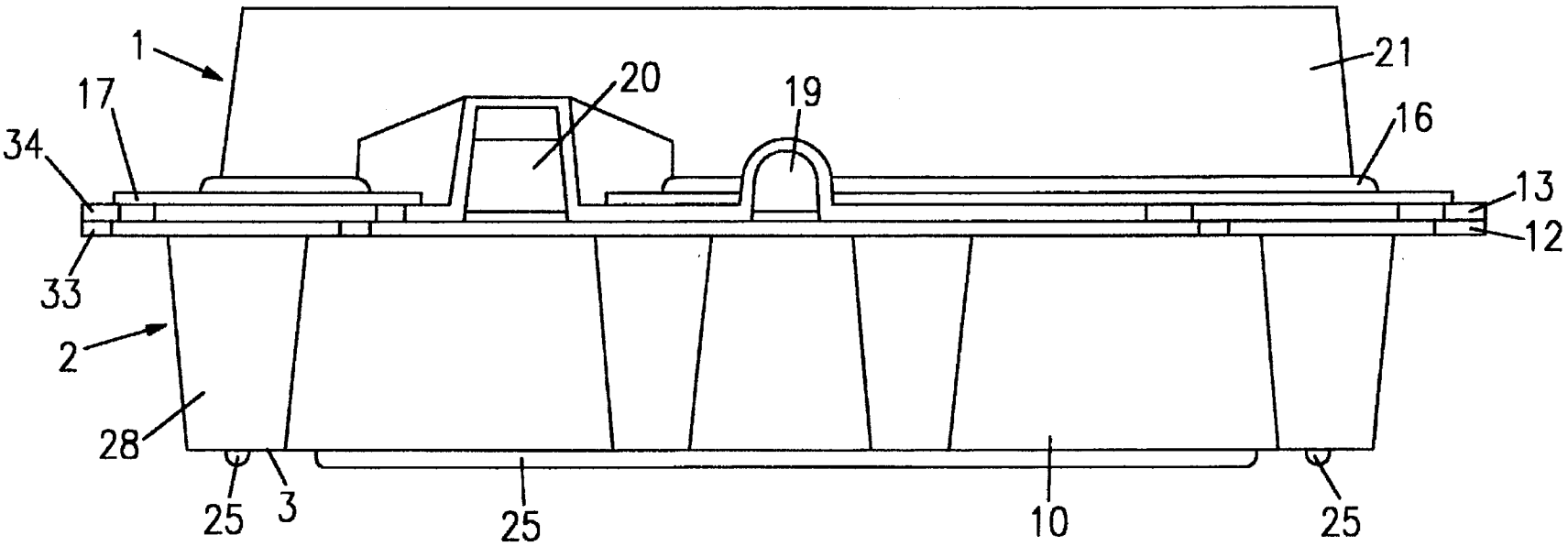
FIG. 8 shows a front view of the preferred embodiment of the Paint Tray in the closed position.
Figure 9:
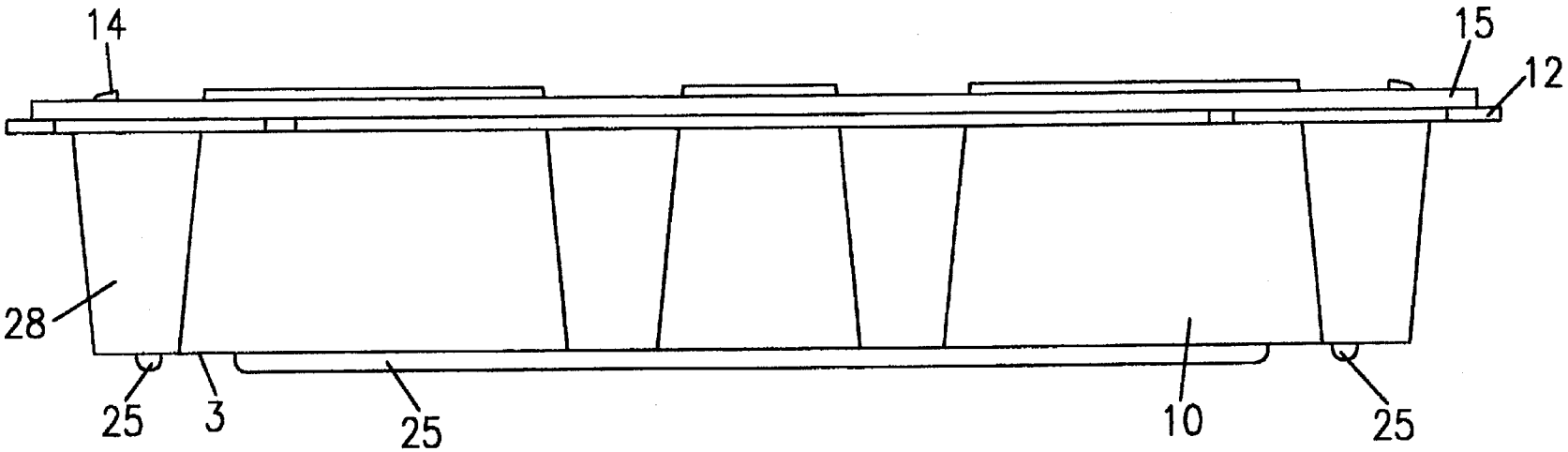
FIG. 9 shows a front view of the preferred embodiment of the Paint Tray in an open position.
Figure 10:
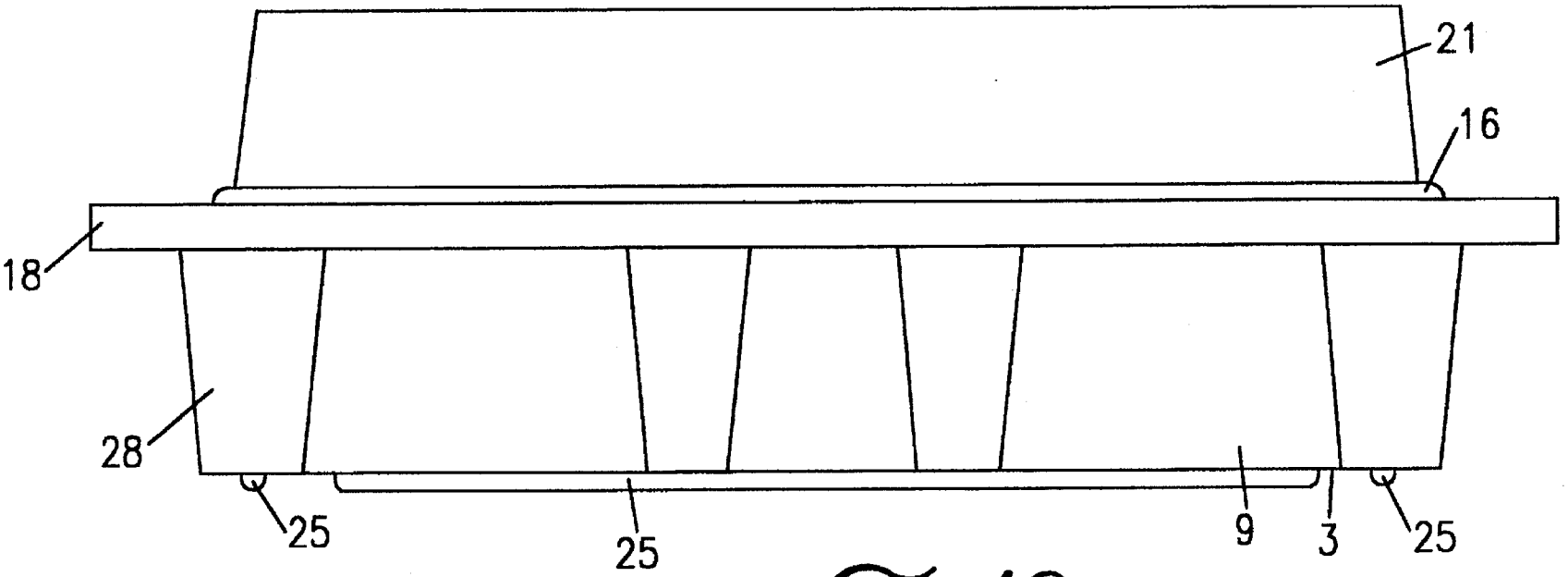
FIG. 10 shows a rear view of the preferred embodiment of the Paint Tray in the closed position.
Figure 11:
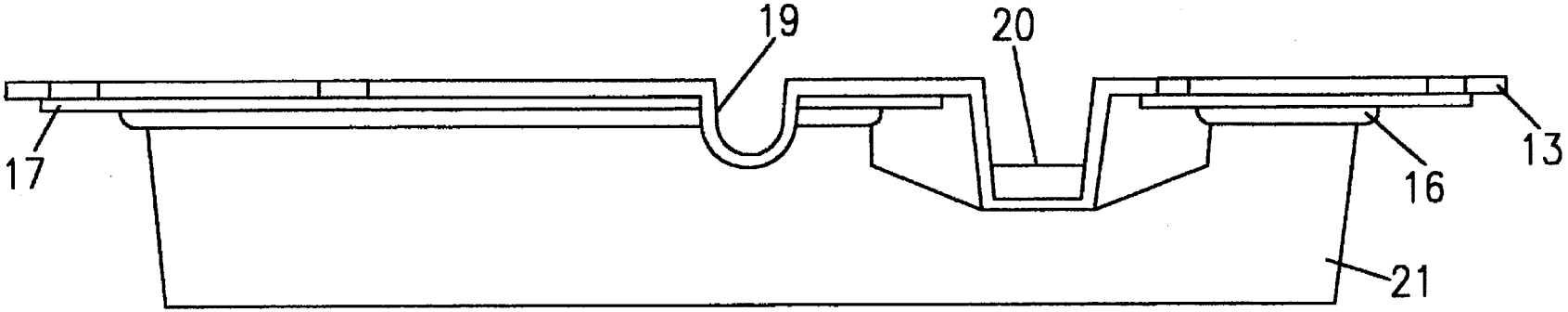
FIG. 11 shows a rear view of the preferred embodiment of the Paint Tray in an open position.
Figure 12:
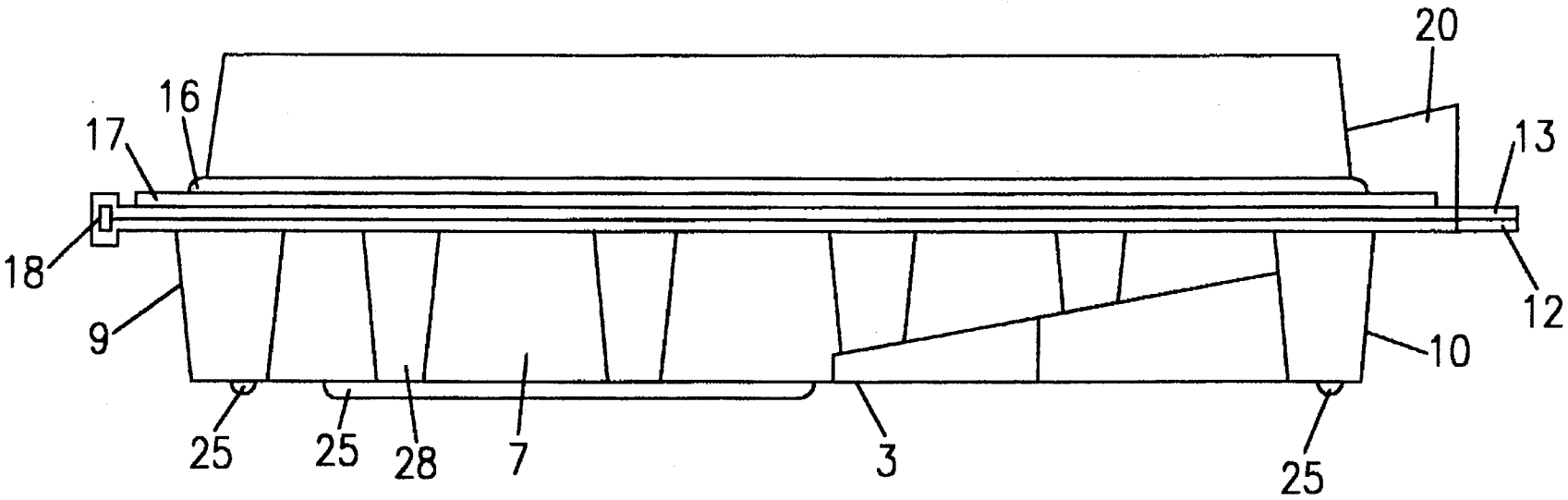
FIG. 12 shows a left side view of the preferred embodiment of the Paint Tray in the closed position.
Figure 13:
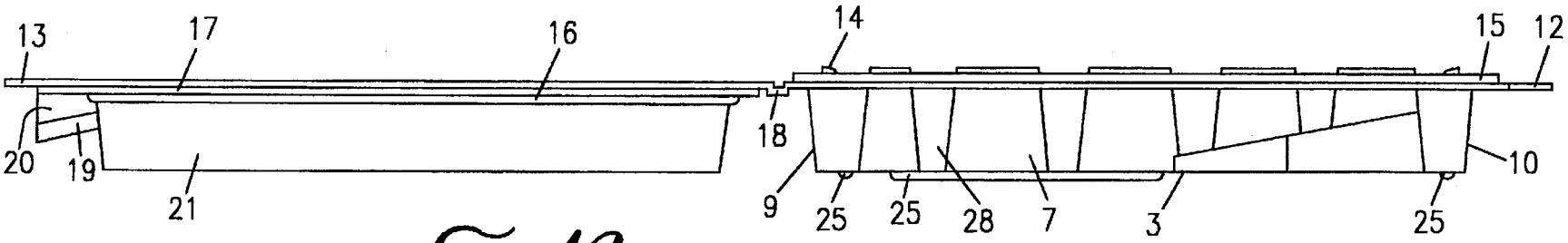
FIG. 13 shows a left side view of the preferred embodiment of Paint Tray in an open position.
Figure 14:
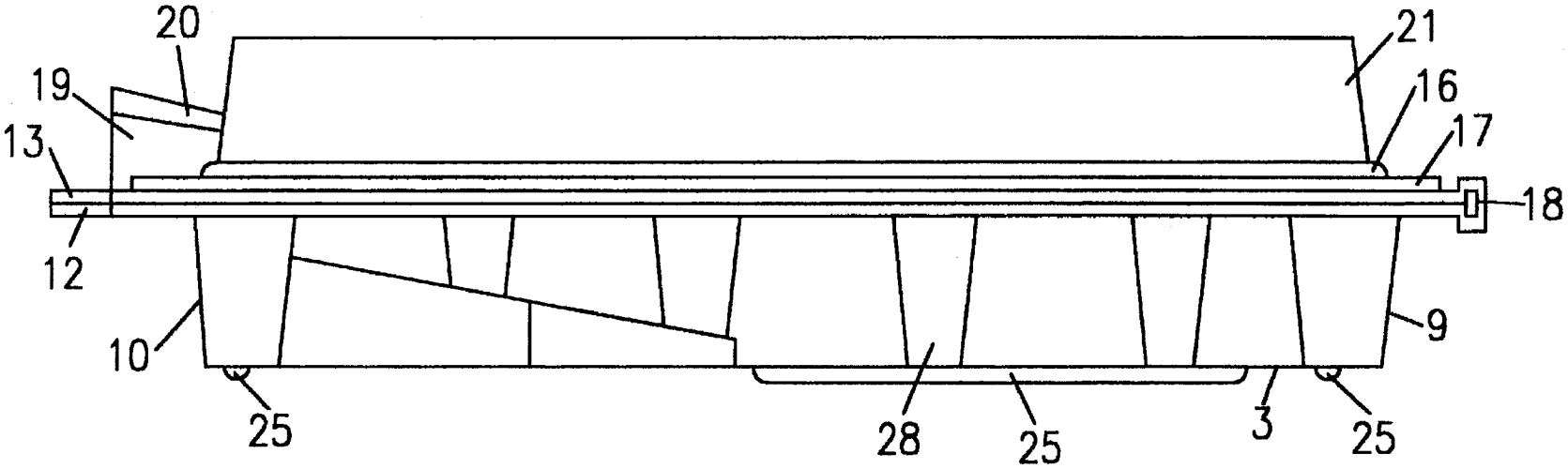
FIG. 14 shows a right side view of the preferred embodiment of the Paint Tray in the closed position.
Figure 15:
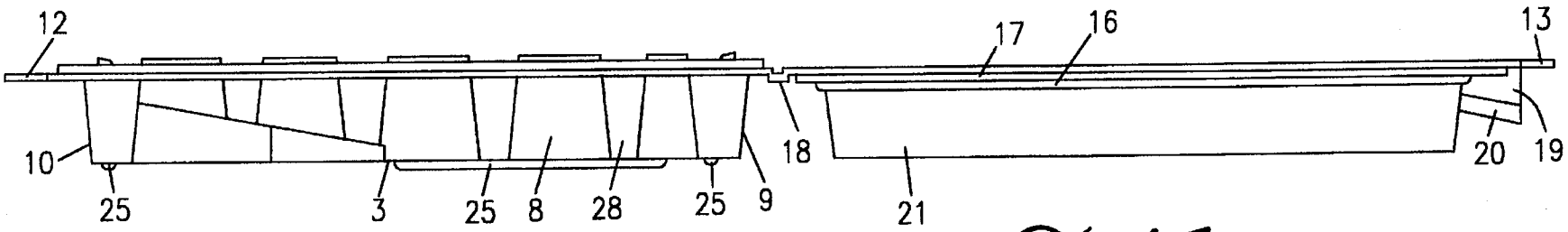
FIG. 15 shows a right side view of the preferred embodiment of the Paint Tray in an open position.
Figure 16:
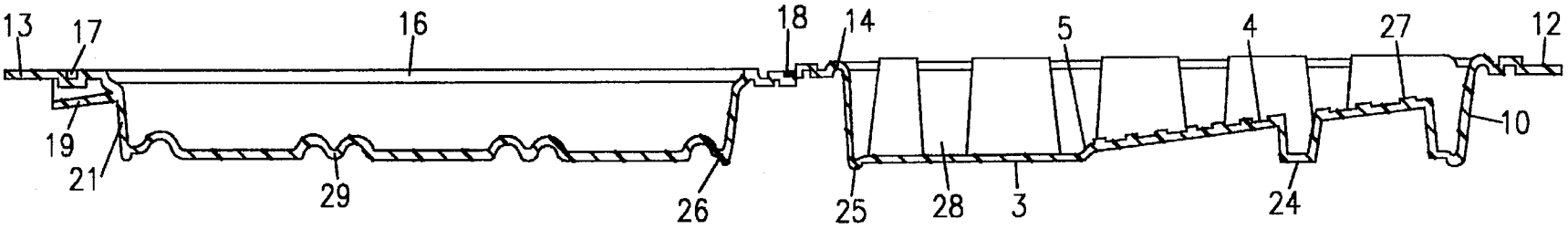
FIG. 16 shows a sectional side view along the length the preferred embodiment of the Paint Tray in an open position, whereby said section is made along lines 16—16 of FIG. 5.

27. Platform Grid (27), is pattern of the raised ribs, notches, bumps, or a combination thereof, which protrude from the surface of the sloped rollout platform (4), and function to remove excess paint (38) from a paint roller (36), when said paint roller (36) is run over the surface of the platform grid (27); in a preferred embodiment of the Paint Tray, the platform grid (27) is a set of parallel "V"-shaped ribs, as shown in FIG. 5.

28. Tray Reinforcing Gusset (28), is the arc-shaped column, generally used as a set of several said gussets (28), and located periodically along the left sidewall (7), the right sidewall (8), the back sidewall (9), and the front sidewall (10) of the tray body (2); this plurality of gussets (28) reinforce and strengthen said sidewalls (7, 8, 9, and 10) of the Paint Tray.

Figure 1:
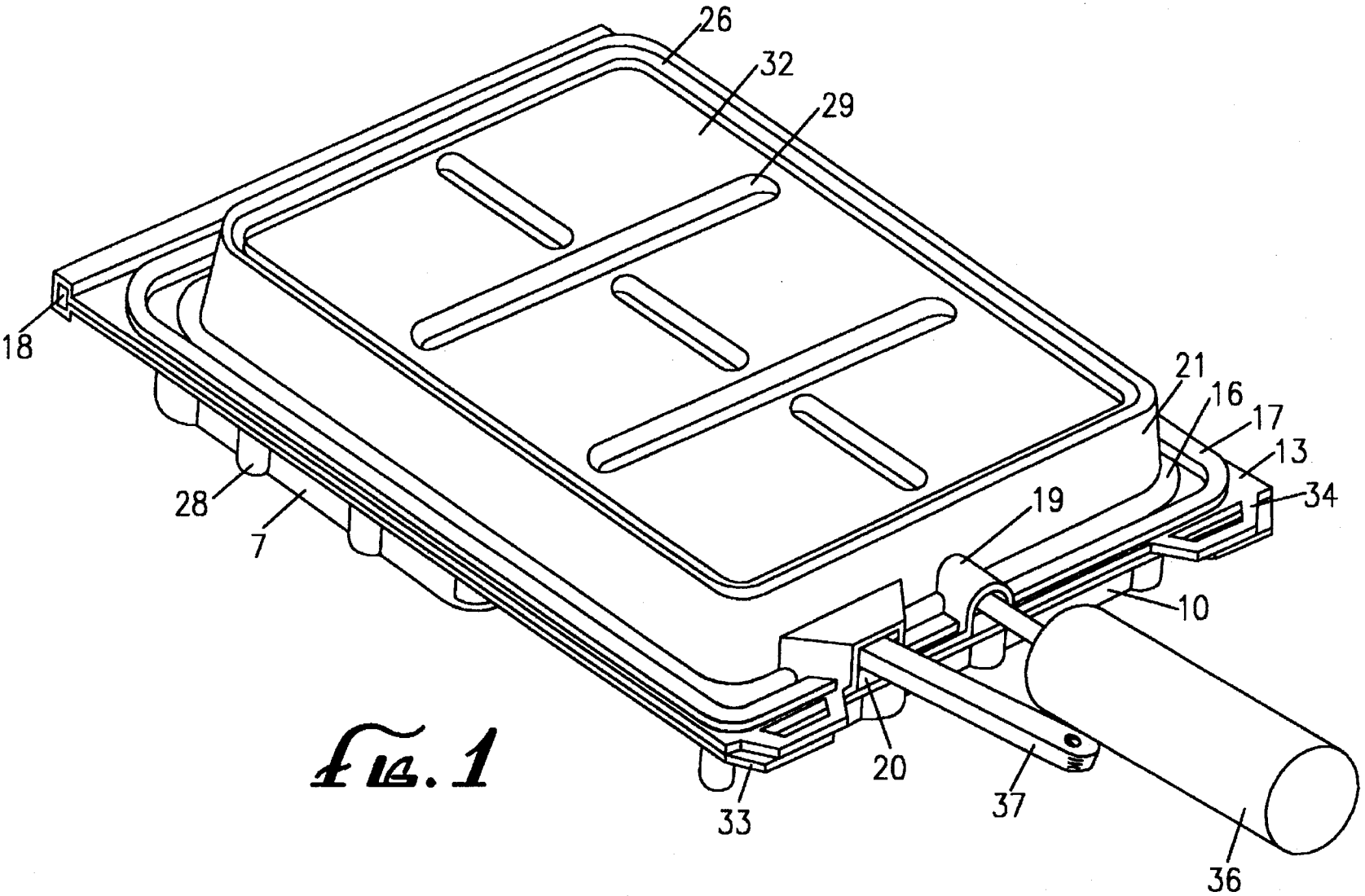
FIG. 1 shows a front isometric top view of the preferred embodiment of the Paint Tray in the closed position, and with a paint brush (37) and a paint roller with handle (36), in the storage position within said tray, and protruding from said tray.

29. Cover Reinforcing Rib (29), is the generally linear rib, and generally used as a set of several said ribs (29), and located on the tray cover (1), as seen in FIG. 1, and generally running the length or the width of said tray cover (1), or a combination thereof, and said rib (29) may be a continuous reinforcing rib (30) or it may be a broken linear rib (31); this plurality of cover reinforcing ribs (29) strengthen the tray cover (1), and provide a set of panels for attaching or molding onto the tray cover indicata surface (32), an indicata, logo, information, a series of user instructions or the like, or a combination thereof.

30. Continuous Reinforcing Rib (30), is a straight, unbroken cover reinforcing rib (29), and in a preferred embodiment of the Paint Tray, runs along the width of the tray cover (1), as shown in FIGS. 1 and 4.

31. Broken Linear Rib (31), is a straight, broken cover reinforcing rib (29), and in a preferred embodiment of the Paint Tray, runs along the length of the tray cover (1), as shown in FIGS. 1 and 4.

32. Tray Cover Indicata Surface (32), is the surface on the tray cover (1), located between the cover reinforcing ribs (29), and acting like set of panels, and where, in some preferred embodiments of the Paint Tray, an indicata, a series of user instructions, or the like may be affixed to or formed into said surface (32).

33. Tray Body Tab (33), is the utility tab used in some preferred embodiments, protruding from the left side and the right side of the front outer tray flange (12) of the Paint Tray, and said Tab may optionally be perforated with a utility hole; the tray body tab (33) meets the tray cover tab (34), when the Paint Tray is in the closed position, and said tabs (33 and 34) are optimally slightly parted and slipped askew, to allow the Paint Tray user to easily open the Paint Tray from the closed position.

Figure 3:
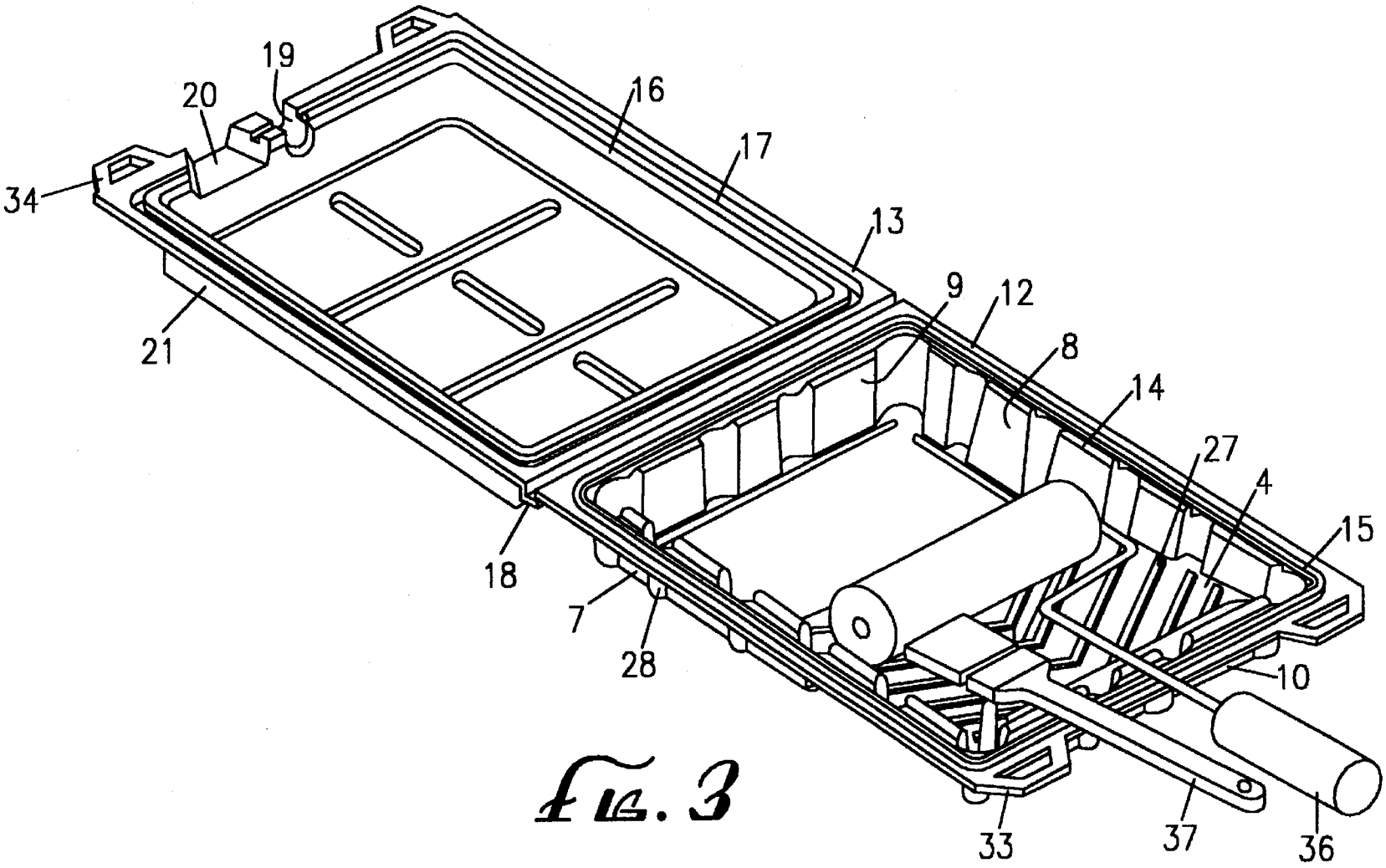
FIG. 3 shows a front isometric top view of the preferred embodiment of the Paint Tray in an open position, and with a paint brush (37) and a paint roller with handle (36), in the storage position, in said tray.

34. Tray Cover Tab (34), is the utility tab used in some preferred embodiments, protruding from the left side and from the right side of the front of the outer cover flange (13) of the Paint Tray, and said tab (34) may optionally be perforated with a utility hole; the tray cover tab (34) meets the tray body tab (33), when the Paint Tray is in the closed position, and said tabs (33 and 34) are optimally slightly parted and slipped askew, to allow the Paint Tray user to easily open the Paint Tray from the closed position. See FIGS. 1 and 3.

35. Paint Tray Liner (35), is a standard paint tray liner (35), which fits into the tray body (2), and the Paint Tray is designed so that the tray cover (1) may be completely closed over the tray body (2), even when said paint tray liner (35) is within the tray body (2).

36. Paint Roller with Handle (36), is a standard paint roller with handle (36), which completely fits into the tray body (2), when the roller is in the paint well (11) region; and said paint roller with handle (36) may be stored within the Paint Tray, and out of the paint well (11), with the roller resting on the sloped rollout platform (4), and the paint roller's (36) handle protruding from the semicircular opening (19), when the Paint Tray is in the closed position. The standard sized paint roller with handle (36) also fits into the standard sized paint tray liner (35), when housed within the tray body (2).

37. Paint Brush (37), is a standard paint brush (37), which completely fits into the tray body (2), when the paint brush (37) is in the paint well (11) region; and said paint brush (37) may be stored within the Paint Tray, and out of the paint well (11), with the paint brush (37) resting on the sloped rollout platform (4), and the paint brush's (37) handle protruding from the rectangular opening (20), when the Paint Tray is in the closed position.

38. Paint (38), is standard paint, which is the typical commercially available paint, which is compatible with polymeric materials, such as PETE.

39. Liner Inner Radius (39), is the recessed radius running the perimeter of the bottom surface of the paint tray liner (35), and which will matedly fit over the protruding tray inner radius (14) on the tray body (2), and said tray inner radius (14) will securely hold the paint tray liner (35) within the tray body (2). The Liner Inner Radius (39) is a protruding radius, when viewed from the top, and runs the perimeter of the top surface of the paint tray liner (35), this protruding liner tray radius (39) matedly fits together with the recessed cover inner radius (16), when said liner inner radius (39) is matedly set over the tray inner radius (14), and when the tray cover (1) is flipped over the top of the tray body (2), thereby placing the Paint Tray in the closed position.

DESCRIPTION OF THE PRESENT INVENTION

In trying to solve these painting industry and home repair problems and product disadvantages, and within the scope of this objective, it was surprising to find that a solution to the above described problems and disadvantages need not be expensive or involve complex or expensive technology.

The objectives and advantages of a simple embodiment of the present invention are:

1. This Paint Roller Tray with Cover is a one piece construction, and will therefore be less expensive to mold, and assemble for packaging and distribution.

2. This Paint Roller Tray with Cover is a one piece construction, and will therefore be more convenient for the user, as the tray cover (1) is attached to the Paint Tray and is readily available to cover the Tray, when interupting a paint job temporarily and keeping the paint relatively fresh, and for safety and preserving the integrity of the paint (38) contained therein, as a covered Paint Tray will afford the user some protection against spills and contamination of the paint (38).

3. This Paint Roller Tray with Cover is designed to house a standard size paint tray liner (35) within the tray body (2); and, the tray cover (1) will close over said Paint Tray, even when there is a paint tray liner (35) housed within the tray body (2).

4. This Paint Roller Tray with Cover is a one piece construction and may close in a clam shell fashion, along a hinge located along the width, and approximately in the middle of the length of the open Paint Tray, whereby the tray cover (1) stays shut and restricts the amount of fresh air in exposure to the paint surface, thereby inhibiting the hardening of the paint (38), and allowing the user to close the cover over the Paint Tray and return later to a tray of relatively fresh paint, for a longer period of time, and, e.g., the next day, if desired.

5. This Paint Roller Tray with Cover may house paint tools, such as a paint brush (37) and a paint roller with handle (36) on the sloped rollout platform (4), and with the handle of said brush (37) and said roller handle (36) protruding from the rectangular opening (20) and the semicircular opening (19), respectively, with the tray cover (1) in the closed position, so that the user may interupt using the Paint Tray, and may return to use said Tray the next day or later, if desired.

6. This Paint Roller Tray with Cover is a one piece construction whereby the interface between the tray body (2) and the tray cover (1) acts as the hinge (18), and said hinge (18) further acts as a preliminary alignment device, to align the various elements, and particularly the elements on the tray body (2) with their mates on the tray cover (1), of the Paint Tray.

7. This Paint Roller Tray with Cover may be composed of a transparent or transleucent material, which has advantages in packaging the Paint Tray, for retail display, whereby paint tools, such as a paint brush (37) and paint roller with handle (36) may be housed within the Tray, with the tray cover (1) in the closed position.

8. This Paint Roller Tray with Cover has a paint flow channel (22), which increases the paint storage capacity of the Paint Tray, and may in some embodiments, nearly double the volume of the paint (38) that would normally be in the paint well (11).

9. This Paint Roller Tray with Cover has paint flow sub-channels (23) which also function as tray legs (24), holding said Paint Tray level and in a stable position.

10. This Paint Roller Tray with Cover has, in some preferred embodiments, has reliefed regions or slots, or the like on the exterior surface of the Cover, i.e., leg rib receptors (26), whereby the leg ribs (25) protruding from the bottom of the tray legs (24) may be matedly fit into said receptors (26), thereby making the Paint Trays stackable in the closed position.

11. This Paint Roller Tray with Cover has a sloped rollout platform (4) with a platform grid (27) and with a paint flow channel (22) designed to evenly and efficiently remove excess paint (38) from the cylindrical surface of the paint roller, when said roller is run over said platform (4).

Further objects, features, and advantages of the present invention will become more apparent from the following description, when taken with the accompanying drawing figures, which show, for purposes of illustration only, an embodiment construction in accordance with the present invention.

DESCRIPTION OF A SIMPLE EMBODIMENT OF THE PAINT TRAY

Referring now to the drawing figures, the reference numerals used to describe the various parts of the invention are shown following mention of the part or element of the invention in the text of the specification herein. Like reference numerals are used to refer to like specific parts or elements in the various Figures. The reference numerals used throughout the text of the specification are enclosed in parentheses, for the convenience of the reader in finding the reference numerals, and to avoid potential ambiguity.

In a simple embodiment, the Paint Tray is a molded, one-piece paint tray with cover, with the molded hinge (), allowing the tray cover (1) to flip over the tray body (2) in a clam shell manner. The tray body (2) has four sidewalls, i.e., a left sidewall (7), a right sidewall (8), a back sidewall (9), and a front sidewall (10), and each sidewall has two neighboring sidewalls, one on each of its two lengthwise ends. See, e.g., FIG. 5. The back sidewall (9) is transition between the rear sidewall and the rear slope of the paint well (6). The tray body (2) has a solid bottom comprised essentially of a paint well (11), the sloped rollout platform (4), the paint flow channel (22), and the tray legs (24). The paint well (11) generally runs the length and width of the rear region of the tray body (2), and the sloped rollout platform (4) generally runs the length and width of the front of the tray body (2). The paint well (11) and the sloped rollout platform (4) are disjoint element, i.e., they are distinct and separate elements. The paint flow channel (22) is generally located within the sloped rollout platform (4). The elements at the lowest and essentially equivalent elevation in the tray body (2), are the paint well bottom (3) and the bottom of the paint flow channel (22), which generally runs from the front of the tray body (2) to the paint well (11), located near the rear of the tray body (1). The bottom of the paint flow channel (22) and its sub-channels (23), being at the lowest elevation on the tray body (2), also function as the tray legs (24), along with the paint well bottom (3). The paint flow channel (22) is in fluidic communication with the paint well (11), when there is paint (38) in said paint flow channel (22), such that paint (38). The sloped rollout platform (4) is sloped toward the paint well (11) at within 5 degrees of a 5 degree angle, with the highest elevation of said platform (4) located at the front of the Paint Tray, and the lowest elevation of said platform (4) located at the front of the paint well (11). The slope between the terminal end of the sloped rollout platform (4) and the beginning of the paint well (11), i.e., the front slope of the paint well (5), is at within 30 degrees of a 60 degree angle. The surface of the sloped rollout platform (4) has a platform grid (27) on its surface, and a paint flow channel (22) on said platform's (4) surface, and in some embodiments, the paint flow channel (22) is also along the front, left, or right side of the platform (4), or along a combination of said sides, of the platform (4).

Figure 2:
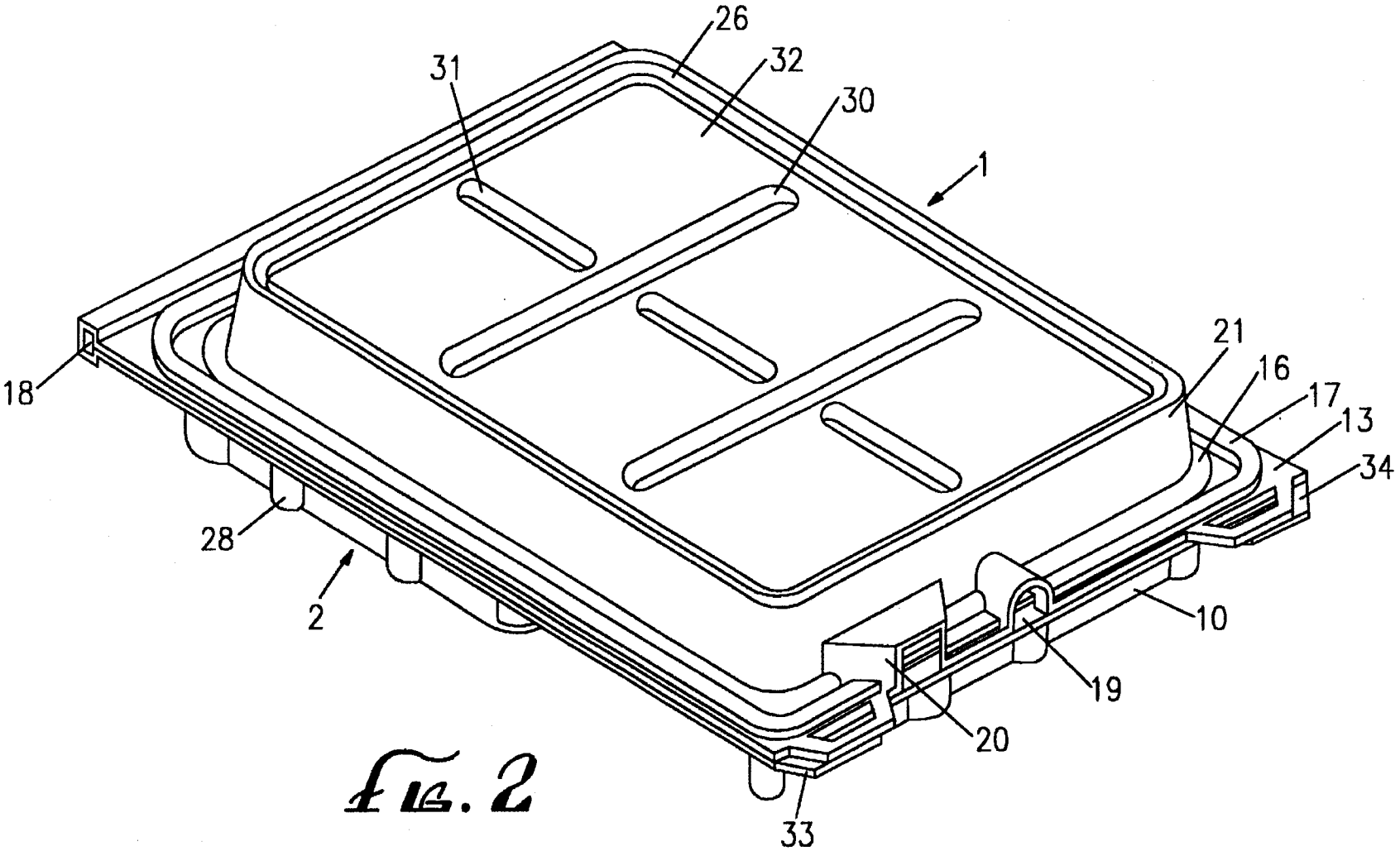
FIG. 2 shows a front isometric top view of the preferred embodiment of the Paint Tray in the closed position.

At the interface between the tray body (2) and the tray cover (1), there is a hinge (18), allowing the tray cover (1) to flip over the tray body (2), and cover said tray body (2). The hinge (18) also acts as a preliminary alignment device, to align the various mating elements on the tray body (2), with their mates on the tray cover (1). Such mating elements include the tray inner radius (14), which matedly fits with the cover inner radius (16), and the tray body alignment tang (15), which matedly fits with the cover alignment tang (17), when the tray cover (1) is flipped over the tray body (2), thereby taking the Paint Tray from the open position (FIG. 5) to the Paint Tray in the closed position (FIG. 2). The tray inner radius (14) has the design and utility of being able to mate with and house the liner inner radius (39) of a paint tray liner (35), and when the Paint Tray is in either the open position or the closed position. See FIGS. 17 and 19. The cover inner radius (16) has the design and utility of being able to mate with the liner inner radius (39), when said liner inner radius (39) is matedly set over the tray inner radius (14), and when the tray cover (1) is flipped over the tray body (2), thereby placing the Paint Tray in the closed position.

The tray cover (1) has an elevated region protruding from its top, i.e.. the elevated top of cover (21), which provides more storage capacity for the Paint Tray when displayed commercially, and provides more space for the paint tray roller with handle (36) to fit more easily on the rollout platform (4).

The tray cover (1) has mating elements which mate with their respective mating elements located on the tray body (2), when the Paint Tray is in the closed position, as decribed above. The front of the tray cover (1) has two openings (19 and 20), semicircular opening (19) and the rectangular opening (20). The semicircular opening (19) is optionally used to allow a paint roller with handle (36) to be housed within the Paint Tray, and outside the paint well (11) and on the sloped rollout platform (4). with the handle of said paint roller (36) protruding from the Paint Tray, when said Tray is in the closed position, as well as the open position. The rectangular opening (20) is optionally used to allow a paint brush (37) to be housed within the Paint Tray, and outside the paint well (11) and on the sloped rollout platform (4), with the handle of said brush (37) protruding from the Paint Tray, when said Tray is in the closed, as well as the open position.

DESCRIPTION OF A PREFERRED EMBODIMENT OF THE PAINT TRAY

In a preferred embodiment of the Paint Tray, the features are essentially the same as is described in the simple embodiment, with the following additional elements.

The preferred embodiment has a plurality of tray reinforcing gussets (28) located periodically along the left sidewall (7), the right sidewall (8), the back sidewall (9), and the front sidewall (10) of the tray body (2). This plurality of tray reinforcing gussets (28) strengthen and reinforce said sidewalls (7, 8, 9, and 10) of the Paint Tray.

The preferred embodiment also has a plurality of cover reinforcing ribs (29) located on the tray cover (1), and generally running the length and width of the said tray cover (1). In the preferred embodiment of the Paint Tray, the cover reinforcing ribs (29) either intersect at 90 degree angles, as they are running the length and width of said tray cover (1), or, as in the present preferred embodiment, they do not intersect, as the lengthwise continuous reinforcing ribs (30) are not intersected by the widthwise broken linear ribs (31), because said ribs (31) running the width of said tray cover (1) are broken, and thereby avoid such rib (29) intersection. This plurality of ribs (29) strengthen and reinforce the tray cover (1). Another utility of these ribs (29) is to provide a set of panels for attaching or molding onto the tray cover indicata surface (32), an indicata, logo, information, a series of user instructions or the like, or a combination thereof.

The preferred embodiment of the Paint Tray also has two tray body tabs (33) and two tray cover tabs (34), which may optionally be perforated with a utility hole, and which are protruding from the left side and the right side of the front of the outer tray flange (12) and the outer cover flange (13), respectively, of the Paint Tray. The tray body tab (33) meets the tray cover tab (34), when the paint Tray is in the closed position. See FIGS. 2, 4, 6, and 8. The tray body tab (33) and the tray cover tab (34) are optimally slightly parted and slipped askew, as shown in FIGS. 2, 4, 6, and 8, to allow the Paint Tray user to easily open the Paint Tray from the closed position.

A complete set of views of theis preferred embodinment of the Paint Tray is shown in FIGS. 1 through 20, inclusive, and reference is made thereto.

DESCRIPTION OF A STACKABLE PREFERRED EMBODIMENT OF THE PAINT TRAY

In another variation of the preferred embodiment of the Paint Tray, there are leg ribs (25) protruding from selected tray legs (24) and protruding from the exterior surface of the paint well bottom (3), as well as recessed leg rib receptors (26) located on the exterior surface of the tray cover (1). When two or more Paint Trays are stacked, the stack is further stabilized by means of the leg ribs (25) of the upper Paint Tray, matedly fitting into the leg rib receptors (26) of the lower Paint Tray, as shown in FIG. 20. This stacking Paint Tray embodiment is of particular convenience when there are several painters working simultaneously on a project, and with separate Paint Trays, and also when there are several paint colors, each of which is housed in a separate Paint Tray.

DESCRIPTION OF A MODIFIED EMBODIMENT WITH A "U"-SHAPED PAINT FLOW CHANNEL

The configuration of the paint flow channel (22) in some modified embodiments may be a "U"-shaped paint flow channel (22), such that there is a paint flow sub-channel (23) along the front end of the tray body (2), and two parallel paint flow sub-channels (23), one along the right side of the tray body (2) and the other along the left side of the tray body (2); such that the above-described three paint flow sub-channels (23) are connected as in the letter "U", and the open end of the "U" is connected to the paint well (11), such that paint (38) contained therein would freely flow from the paint flow channel (22) into the paint well (11). The paint flow sub-channels (23) which act as tray legs (24) in this and its variant embodiments provide adequate stability for the Paint Tray, and provide an even draining of the paint tray roller (36).

A variation of this modified embodiment of the Paint Tray, has no paint flow sub-channel (23) located at the front of the tray body (2), and thereby has two parallel paint flow sub-channels (23), with one located on the left side of the sloped rollout platform (4), and the other located on the right side of the sloped rollout platform (4).

DESCRIPTION OF A MODIFIED EMBODIMENT WITH AN "X"-SHAPED PAINT FLOW CHANNEL

The configuration of the paint flow channel (22) in some modified embodiments may be an "X"-shaped paint flow channel (22), such that there are three connected straight paint flow sub-channels (23), with the front sub-channel located at the front of the tray body (2), and the other two paint flow sub-channels (23) being diagonal and opposing paint flow sub-channels (23), each dividing the sloped rollout platform (4) in two halves, and intersecting near the middle of said platform (4). The paint flow sub-channels (23 which act as tray legs (24) in this and its variant embodiments provide adequate stability for the Paint Tray, and provide an even draining of the paint tray roller (36).

A first variation of this modified embodiment of the Paint Tray, has an additional paint flow sub-channel (23) located at the front of the sloped rollout platform (4), and connected to each of the other two intersecting paint flow sub-channels (23).

A second variation of this modified embodiment of the Paint Tray, has an two additional paint flow sub-channels (23) located on each side of the sloped rollout platform (4), such that one additional paint flow sub-channel (23) is located at the left end of the sloped rollout platform (4), and the other additional paint flow sub-channel (4) is located at the right end of the sloped rollout platform (4).

A third variation of this modified embodiment of the Paint Tray, combines the first and the second variations, supra, and thereby has three additional paint flow sub-channels (23), with one located at the front of the sloped rollout platform (4), and the other additional paint flow sub-channels (23) located at each end of the sloped rollout platform (4), one on the left end of the sloped rollout platform (4), and one on the right end of the sloped rollout platform (4).

DESCRIPTION OF A MODIFIED EMBODIMENT WITH A "Z"-SHAPED PAINT FLOW CHANNEL

The configuration of the paint flow channel (22) in sime modified embodiments may be a "Z"-shaped paint flow channel (22), such that the paint flow channel (22) is comprised essentially of two straight paint flow sub-channels (23), with the front paint flow sub-channel (23) located at the front of the sloped rollout platform (4), and the other, middle paint flow sub-channel (23) being a diagonal sub-channel (23), dividing the sloped rollout platform (4) in two halves. The middle paint flow sub-channel (23) is connected to the front paint flow sub-channel (23) on one end, and to the paint well (11) on the other end, such that paint (38) contained in a sub-channel (23), would flow through the paint flow channel (22), and into the unfilled paint well (11). The paint flow sub-channels (23) which act as tray legs (24) in this and its variant embodiments, provide adequate stability for the Paint Tray, and provide an even draining of the paint tray roller (36).

A first variation this modified embodiment of the Paint Tray, has two additional paint flow sub-channels (23) parallelly located on each lengthwise end of the sloped rollout platform (4), such that one paint flow sub-channel (23) is located at the left end of the sloped rollout platform (4), and the other paint flow sub-channel (23) is located at the right end of the sloped rollout platform (4).

A second variation of this modified embodiment of the Paint Tray, would include the "Z"-shaped modified embodiment, except the "Z"-shaped flow channel (22) would be in the shape of the mirror image of a "Z", or an "S"-shaped flow channel (22).

A third and fourth variation of this modified embodiment of the Paint Tray, would include the "Z"-shaped flow channel (22), except that the "Z"-shaped flow channel (22) would be rotated approximately 90-degrees clockwise, or counterclockwise, for said third and fourth variations, respectively.

DESCRIPTION OF A MODIFIED EMBODIMENT WITH A "V"-SHAPED PAINT FLOW CHANNEL

The configuration of the paint flow channel (22) in some modified embodiments may be a "V"-shaped paint flow channel (22), such that there are two paint flow sub-channels (23), with each paint flow sub-channel (23) running from opposite sides of the front of the sloped rollout platform (4), and towards the center of the rear end of the sloped rollout platform (4), such that paint contained in either paint flow sub-channel (23), would flow through each sub-channel (23), independently, and into the unfilled paint well (11). In some variations of this embodiment, and the variations described, infra, the two paint flow sub-channels (23) may meet at or near the rear of the sloped rollout platform (4), such that paint contained in either paint flow sub-channel (23), could flow through each sub-channel (23), and into the unfilled paint well (11) as one connected paint flow sub-channel (23). The paint flow sub-channels (23) which act as tray legs (24) in this and its variant embodiments, provide adequate stability for the Paint Tray, and provide an even draining of the paint tray roller (36).

A first variation of this modified embodiment of the Paint Tray, the paint flow channel (22) has an additional paint flow sub-channel (23) located at the front of the sloped rollout platform (4), and connected to each of the other two paint flow sub-channels (23).

A second variation of this modified embodiment of the Paint Tray, has two additional parallelly located paint flow sub-channels (23) located on each side of the sloped rollout platform (4), such that one additional paint flow sub-channel (23) is located at the left end of the rollout platform (4), and the other additional paint flow sub-channel (23) is located at the right end of the sloped rollout platform (4).

A third variation of this modified embodiment of the Paint Tray, combines the first and the second variations, supra, and thereby has three additional paint flow sub-channels (23), with one located at the front of the sloped rollout platform (4), and the another paint flow sub-channel (23) located at each end of the rollout platform (4), one on the left end and one on the right end of the sloped rollout platform (4).

A fourth and additional variations of this modified embodiment of the Paint Tray, has the "V"-shaped paint flow channel (22) rotated 180-degree, and this fourth variation may be combined with the above three variations of this modified embodiment to create derivative variations thereof.

DESCRIPTION OF A MODIFIED EMBODIMENT WITH A HYBRID-SHAPED PAINT FLOW CHANNEL

The configuration of the paint flow channel (22) in some modified embodiments may be a hybrid or combination of the above disclosed modified embodiments and their variations of paint flow channels (22). Such combinations may include, e.g., two "X"-shaped paint flow channels (22) connected together in sequence. Such hybrids may include the use of, e.g., a "Z"-shaped paint flow channel and, e.g., a "V"-shaped paint flow channel connected together in sequence.

ADDITIONAL EMBODIMENTS OF THE INVENTION

While I have shown and described in this disclosure only selected embodiments in accordance with the present invention, it is understood that the same is not limited thereto, but is susceptible to numerous changes and modifications as known to one having ordinary skill in the art, and we therefore do not wish to be limited to the details shown and described herein, but intend to cover all such modifications, changes, and eliminations, as are encompassed by the scope of the appended claims.

I claim:

1. A Paint Roller Tray with Cover, comprised essentially a. a tray body, with a front sidewall, a back sidewall, a left side wall, and a right sidewall, and each sidewall has two neighboring sidewalls, and said tray body also has an outer tray flange located around the perimeter of the tray body;

b. the bottom of said tray body comprised essentially of a sloped rollout platform starting at the front end and sloping down into a paint well, said paint well located at the rear of the tray body;

c. said sloped rollout platform has a paint flow channel within the platform's surface, and said paint flow channel also functions as a tray leg;

d. a hinge, located at the interface between said tray body and tray cover, and the tray cover with an elevated top surface on said tray cover, and said tray cover further has an outer cover flange located around the cover's perimeter;

e. said tray cover has a rectangular opening at its front end, and a semicircular opening at its front end;

f. said hinge also acts as a preliminary alignment device, aligning a tray inner radius, located on the tray body, with a cover inner radius, located on the tray cover, so that said radius may be matedly connected when said tray cover is in the closed position; and g. the hinge further acts as a preliminary alignment device, aligning a tray body alignment tang, located on the tray body, with a cover alignment tang, located on the tray cover, so that said radius' may be matedly connected when said tray cover is in the closed position.

2. A Paint Roller Tray with Cover, as recited in claim 1, wherein the front sidewall, the left sidewall, the front sidewall, and the back sidewall, each said sidewall has a plurality of tray reinforcing gussets, located on its sidewall.

3. A Paint Roller Tray with Cover, as recited in claim 1, wherein the tray cover has a plurality of cover reinforcing ribs, located on said tray cover.

4. A Paint Roller Tray with Cover, as recited in claim 1, wherein the Paint Tray has two tray body tabs, wherein the first said tab is protruding from the left side of the front of the outer tray flange, and wherein the second said tab is protruding from the right side of the front of said outer tray flange; and wherein said Paint Tray has two tray cover tabs, wherein the first said tab is protruding from the left side of the front of the outer cover flange, and wherein the second said tab is protruding from the right side of the front of the outer cover flange.

5. A Paint Roller Tray with Cover, as recited in claim 4, wherein said set of two tray body tabs is slightly parted and slipped askew from its mated set of two tray cover tabs, and when the Paint Tray is in the closed position.

6. A Paint Roller Tray with Cover, as recited in claim 5, wherein the front sidewall, the left sidewall, the right sidewall, and the back sidewall, each have a plurality of tray reinforcing gussets, located on said sidewalls; and wherein the tray cover has a plurality of cover reinforcing ribs, located on said tray cover.

7. A Paint Roller Tray with Cover, as recited in claim 6, wherein there are one or more leg ribs protruding from selected tray legs, and wherein said leg ribs are also protruding from the exterior surface of the bottom of said paint well; and wherein there are recessed leg rib receptors located on the exterior surface of the elevated top of said tray cover, said leg ribs from a first Paint Tray would matedly fit into said leg rib receptors of a second Paint Tray.

8. A Paint Roller Tray with Cover, as recited in claim 7, wherein said Paint Tray is composed of a polymeric material.

9. A Paint Roller Tray with Cover, as recited in claim 8, wherein said Paint Tray is composed of PETE.

10. A Paint Roller Tray with Cover, as recited in claim 1, wherein said Paint tray is composed of a composite material, said material being a polymeric material with graphite contained therein.

11. A Paint Roller Tray with Cover, as recited in claim 10, wherein said polymeric material is PETE, and said composite material is PETE with graphite contained therein.

12. A Paint Roller Tray with Cover, as recited in claim 1, wherein said paint flow channel is "U"-shaped.

13. A Paint Roller Tray with Cover, as recited in claim 1, wherein said paint flow channel is "X"-shaped.

14. A Paint Roller Tray with Cover, as recited in claim 1, wherein said paint flow channel is "V"-shaped.

15. A Paint Roller Tray with Cover, as recited in claim 1, wherein said paint flow channel is "Z"-shaped.

16. A Paint Roller Tray with Cover, as recited in claim 1, wherein said paint flow channel is shaped as a hybrid "U", "X", "Z", or "V"-shape, or a combination thereof.

* * * * *